US005349971A

United States Patent [19]

Player

[11] Patent Number: 5,349,971

[45] Date of Patent: Sep. 27, 1994

[54] CLIPPER COMB

[76] Inventor: James E. Player, 3945 Cliftondale Pl., College Park, Ga. 30349

[21] Appl. No.: 851,937

[22] Filed: Mar. 16, 1992

[51] Int. Cl.[5] ..... A45D 24/34

[52] U.S. Cl. ..... 132/213.1; 132/213; 132/214

[58] Field of Search ..... 132/126, 127, 213, 213.1, 132/214, 148, 150, 160

[56] References Cited

U.S. PATENT DOCUMENTS

| | | | |
|---|---|---|---|
| 2,510,943 | 6/1950 | Arnold | 132/150 |
| 2,556,805 | 6/1951 | Forward | 132/213.1 |
| 2,879,777 | 3/1959 | Miller | 132/213.1 |
| 3,115,143 | 12/1963 | Queen | 132/213 |
| 3,382,877 | 5/1968 | Cercone | 132/213.1 |
| 3,572,351 | 3/1971 | Perry | 132/213.1 |
| 3,638,665 | 2/1972 | Staffas, Sr. | 132/213.1 |
| 4,505,283 | 3/1985 | Pischdotchian | 132/213.1 |
| 5,012,830 | 5/1991 | Vaccaro et al. | 132/213.1 |
| 5,131,418 | 7/1992 | Vaccaro | 132/213.1 |

FOREIGN PATENT DOCUMENTS

| | | | |
|---|---|---|---|
| 0560041 | 6/1923 | France | 132/214 |
| 275627 | 8/1951 | Switzerland | 132/160 |

*Primary Examiner*—Gene Mancene
*Assistant Examiner*—Frank A. LaViola

[57] ABSTRACT

A clipper comb 10 for manipulating hair as it is cut with an electric clipper 46 has a handle 14 and an array of juxtaposed teeth 11 forming a bed 30. The bed has a clipper bearing surface 31, a forward segmented guide wall 32 and a rearward guide wall 33 for guiding the electric clipper upon the comb.

6 Claims, 1 Drawing Sheet

CLIPPER COMB

TECHNICAL FIELD

This invention relates to combs for manipulating hair as it is cut with an electric clipper.

BACKGROUND OF THE INVENTION

Electric clippers have been used to cut hair close to the scalp and to cut the short hairs growing on the neck. To cut hair to longer lengths, the clippers have been provided with wedge-like attachments which raise the clipper from the scalp. However, with or without the attachment the clippers follow the contour of the head thereby cutting most hairs to a uniform length.

Combs have long been used by barbers and hair stylists to gather sections of hair to be cut. The comb is held in one hand of a barber and the hair cut close to the comb with scissors or an electric clipper held by the other hand. Sections of hair are cut in this manner to give a head of hair an evenly layered appearance. However, because of errors in estimating the proper position of the comb prior to cutting, sections of hair may be cut to undesired lengths, thus giving the head of hair an uneven appearance.

Large platform-like combs have also been used so that sections of hair pass through the comb and are cut by an electric clipper sliding over it. However, with this type of comb its teeth are often buried deep within the hair making them difficult to see and therefore difficult to keep the clipper on the comb.

It thus is seen that a need remains for a comb for manipulating hair in a manner by which an electric clipper may more securely and evenly cut hair. Accordingly, it is to the provision of such a comb that the present invention is primarily directed.

SUMMARY OF THE INVENTION

In a preferred form of the invention a clipper comb for manipulating hair as it is cut with an electric clipper comprises an array of juxtaposed teeth forming a generally flat, segmented clipper bearing surface. Clipper guide walls border opposite sides of the bearing surface. The comb also has a handle. With this construction, hairs may be manipulated by the comb into a position with their ends extending between the teeth over the clipper bearing surface and cut by sliding an electric clipper upon the bearing surface in sliding contact a clipper guide wall. For longer hair cuts nestable spacers are mounted upon the comb.

DETAILED DESCRIPTION

Figure 1:
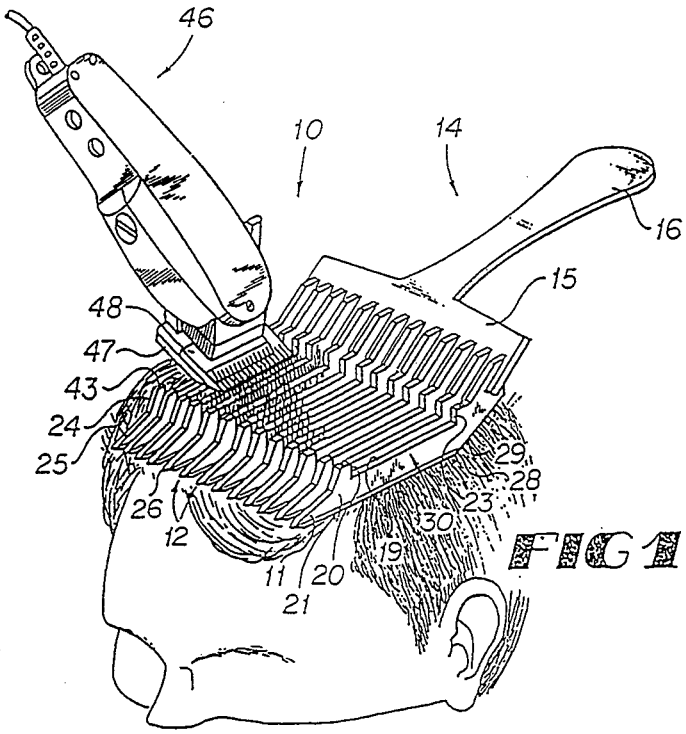
FIG. 1 is a perspective view of a clipper comb that embodies principles of the invention in a preferred form shown upon a head with an electric clipper supported thereon in the process of cutting a head of hair.
Figure 2:
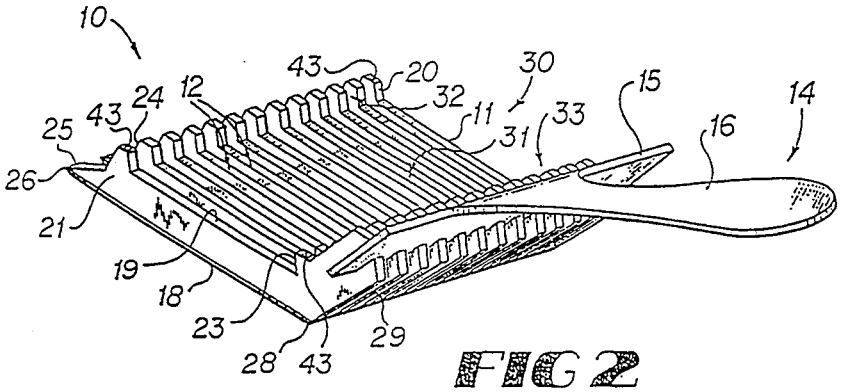
FIG. 2 is another perspective view of the comb of FIG. 1.

With reference next to the drawing, there is shown a clipper comb 10 having an array of thirteen elongated, juxtaposed, evenly spaced apart teeth 11 forming open slots 12 between each adjacent pair of teeth. The comb

10 has a base portion or spine 15 from which the teeth extend and a handle 14 with elongated hand gripping portion 16 that extends from the other side of the spine.

Each tooth 11 has a V-shaped lower surface 18 and a flat, upper, clipper bearing surface 19 bounded at opposite ends by a forward guide wall or shoulder 20 of a projection 21 and a rear guide wall or shoulder 23. The guide walls 20 and 23 are oriented uprightly generally normal to the bearing surface 19 with the walls 20 being coplanar and with the walls 23 being coplanar and parallel with the walls 20. Each projection 21 has a steeply tapered front surface 24 which extends downwardly to a shallowly tapered surface 25 that extends to a leading tooth edge 26. Each tooth also has a rear inclined surface 29 extending from a rear end 28 of the V-shaped lower surface 18 towards the handle 14. The teeth collectively form a bed 30 having a flat, segmented clipper bearing surface 31 bounded by the forward guide wall 32 and the rear guide wall 33 which surface is the cumulative surface provided by the upper surface 19 of the individual teeth.

Figure 3:
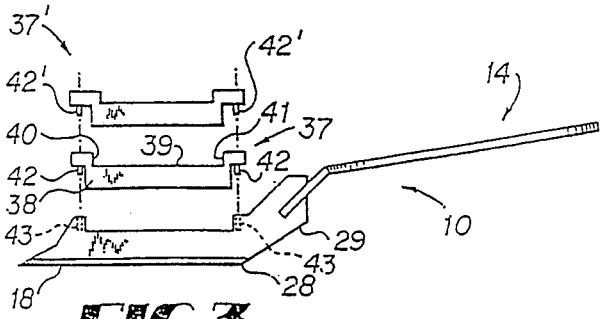
FIG. 3 is a side view of the comb of FIG. 1 shown with two nestable spacers positioned thereabove for attachment.
Figure 4:
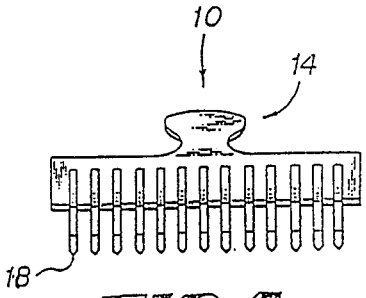
FIG. 4 is a front view of the comb of FIG. 1.

As best shown in FIG. 3, the comb may be provided with a nestable spacer 37 having teeth 38 sized and shaped to overlay the teeth 11 of the comb in register therewith. Each spacer tooth 38 has a flat clipper bearing surface 39 bounded by a forward guide wall 40 and a rear guide wall 41 which are oriented normal to the clipper bearing surface 39. The spacer 37 has four corner posts 42 which are sized and shaped to be received in four holes 43 formed in the end member teeth of the comb 10. Another spacer 37' of like construction is provided that may be nested upon spacer 37. It has corner post 42' sized and shaped to be received in unshown holes in spacer 37.

In use, a conventional electric clipper 46 having a lower shearing plate 47 and an upper, reciprocating shearing plate 48 may be used in conjunction with the comb in cutting a head of hair. The comb 10 is pushed into a section of hair causing strands of hair to pass between the teeth leading edges 26 and into the slots 12. In doing this the V-shaped lower surfaces 18 of the teeth aid in channeling the hair into the slots 12. As the comb moves through the hair the shallow taper surface 25 lifts strands of hair from the scalp so that the steep taper surface 24 may then orient them to extend straight out from the scalp. Continued movement of the comb into the hair section brings the stands into positions within the slots between the forward guide wall 32 and the rearward guide wall 33. Should a particular hair style dictate that the hair be cut progressively longer or shorter in one direction upon the scalp, the comb may be tilted about the teeth trailing edge 28 to a desired angle from the underlying head. When this is done the comb handle remains away from the hair due to its elevated position.

Once the comb is properly positioned, the clipper 46 is placed upon the comb 10 with the clipper lower shearing plate 47 in slidable contact with the clipper bearing surface 31 of the bed 30 between the guide walls 32 and 33. The clipper is thereby confined between the two sides of the bed 30 between the guide walls 32 and 33. The clipper is slid upon the bed along a selected guide wall thereby cutting a swath in the hair with a well defined side to the level of the bed. The clipper may be repetitively slid in this manner over the bearing surface 31 until all the strands of hair between the forward guide wall 32 and the rearward guide wall 33 are cut. The comb may then be moved forward to another position upon the head or placed elsewhere.

As previously mentioned, the comb may be provided with a nestable spacer 37. The spacer is snap fitted onto the comb to provide additional spacing from the scalp should one desire to cut the hair to a longer length. The additional spacer 37' may also be snap fitted onto spacer 37 for even greater hair length. The clipper bearing surface 39, forward guide wall 40 and rear guide wall 41 of the spacers similarly confine the electric clipper in the same manner as previously described.

From the foregoing it is seen that a clipper comb is now provided which overcomes problems long associated with those of the prior art. It should however be understood that the just described embodiment merely illustrates principles of the invention in its preferred form. Many modifications, additions and deletions may, of course, be made without departure from the spirit and scope of the invention as set forth in the following claims.

I claim:

1. A clipper comb for manipulating hair as it is cut with an electric clipper, the clipper comb comprising:

a base having an array of juxtaposed teeth forming a generally flat, segmented clipper bearing surface;

a handle extending from a first end of said base;

a first clipper guide wall bordering one side of said clipper bearing surface and oriented generally perpendicular to said clipper bearing surface;

a second clipper guide wall oriented generally perpendicular to said array of teeth and bordering a side of said bearing surface opposite said first clipper guide wall, said first and second clipper guide walls being substantially parallel to each other;

said teeth have first coplanar bottom surfaces beneath said clipper bearing surface and second coplanar bottom surfaces that extend angularly from said first coplanar bottom surfaces;

a spacer nested against said clipper bearing surface and at least one of said first and second clipper guide walls, said spacer having an array of juxtaposed teeth forming a generally flat spacer clipper bearing surface.

2. The clipper comb of claim 1, wherein at least one of said first and second clipper guide walls are formed by an array of raised portions located adjacent leading edges of said teeth.

3. The clipper comb of claim 2, wherein said teeth taper from said raised portions to said teeth leading edges.

4. The clipper comb of claim 11, wherein said teeth have a V-shaped surface opposite said clipper bearing surface for channeling strands of hair between adjacent teeth.

5. The clipper comb of claim 1, wherein said spacer has a first clipper guide wall bordering one side of said spacer clipper bearing surface and oriented generally parallel to at least one of said first and second comb clipper guide walls.

6. The clipper comb of claim 5, wherein said spacer has a second clipper guide wall bordering a side of said spacer clipper bearing surface opposite said first spacer clipper guide wall.

* * * * *